US009982972B2

(12) United States Patent
Huang et al.

(10) Patent No.: US 9,982,972 B2
(45) Date of Patent: May 29, 2018

(54) COMPRESSION MOLDED COMBINED FIREWORK

(71) Applicant: LIUYANG YIHELONG FIREWORKS GROUP. CO., LTD, Hunan (CN)

(72) Inventors: Guanghui Huang, Liuyang (CN); Mingchu Huang, Liuyang (CN)

(73) Assignee: LIUYANG YIHELONG FIREWORKS GROUP CO., LTD, Liuyang, Hunan (CN)

( * ) Notice: Subject to any disclaimer, the term of this patent is extended or adjusted under 35 U.S.C. 154(b) by 260 days.

(21) Appl. No.: 14/442,090

(22) PCT Filed: Mar. 12, 2013

(86) PCT No.: PCT/CN2013/072439
§ 371 (c)(1),
(2) Date: May 11, 2015

(87) PCT Pub. No.: WO2014/071713
PCT Pub. Date: May 15, 2014

(65) Prior Publication Data

US 2015/0300790 A1 Oct. 22, 2015

(30) Foreign Application Priority Data

Nov. 12, 2012 (CN) ..... 2012 1 0447718

(51) Int. Cl.
*F42B 4/24* (2006.01)
*F42B 4/20* (2006.01)

(52) U.S. Cl.
CPC . *F42B 4/24* (2013.01); *F42B 4/20* (2013.01)

(58) Field of Classification Search
CPC ..... F42B 4/20; F42B 4/24; F42B 4/00; F42B 4/06; F42B 4/14; F42B 4/10; F42B 8/16;
(Continued)

(56) References Cited

U.S. PATENT DOCUMENTS 1,770,921 A * 7/1930 Hitt ..... F42B 4/24 102/360
2,103,936 A * 12/1937 Decker ..... F42B 4/24 102/357

(Continued)

FOREIGN PATENT DOCUMENTS

CN 201945251 U * 8/2011

*Primary Examiner* — Troy Chambers
*Assistant Examiner* — Bridget Cochran
(74) *Attorney, Agent, or Firm* — Raymond Y. Chan; David and Raymond Patent Firm

(57) ABSTRACT

A compression molded combined firework includes a plurality of tubular cavity bodies evenly distributed in parallel on a body. Upper ends of the tubular cavity bodies are open, lower ends of the tubular cavity bodies are closed. Chemicals for launching fireworks and effect parts are disposed in the tubular cavity bodies. Flash holes penetrating through the bottom surface of the body are formed in the closed ends of the tubular cavity bodies. Bottom surface openings of the flash holes are located in a wiring groove. A blocking groove is disposed in the wiring groove and between the bottom surface openings of the flash holes. The wiring groove is sealed with glue. The glue forms a closed ring shape along the cross section direction of a leading wire in the wiring groove, thereby blocking a channel where powder gas goes forwards along a gap, and eliminating the phenomenon of blaze.

27 Claims, 5 Drawing Sheets

(58) Field of Classification Search
CPC .. F42B 5/08; F41A 19/63; F41A 19/69; F42D 1/045; F42C 11/00; F42C 9/14
USPC ..... 102/360
See application file for complete search history.

(56) References Cited

U.S. PATENT DOCUMENTS 2,848,946 A * 8/1958 Goebig ..... F42B 4/20 102/343
3,280,744 A * 10/1966 Brown ..... F42B 4/20 102/358
4,012,985 A * 3/1977 Magnusson ..... F42B 5/15 102/380
5,429,053 A * 7/1995 Walker ..... F42B 4/20 102/342
6,393,990 B1 * 5/2002 Fagan ..... F41F 1/06 102/342
7,568,431 B1 * 8/2009 Stria ..... F42B 4/24 102/202.14
2005/0133472 A1 * 6/2005 Deye ..... F42B 4/20 211/60.1
2005/0204911 A1 * 9/2005 Barat ..... F42B 3/26 89/1.816
2006/0164787 A1 * 7/2006 Deye ..... F42B 4/00 361/249
2008/0276820 A1 * 11/2008 Huang ..... F42B 4/14 102/360
2012/0210897 A1 * 8/2012 Johnson, Jr. ..... F42B 4/20 102/215
2014/0224143 A1 * 8/2014 Li ..... F42B 4/00 102/360
2015/0176946 A1 * 6/2015 Montgomery ..... F41F 1/06 89/1.816
2015/0300790 A1 * 10/2015 Huang ..... F42B 4/24 102/360

* cited by examiner

COMPRESSION MOLDED COMBINED FIREWORK

CROSS REFERENCE OF RELATED APPLICATION

This is a non-provisional application that claims priority to an international application number PCT/CN2013/072439, international filing date Mar. 12, 2013.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an entertainment pyrotechnic products, and more particularly to a combination of fireworks.

Description of Related Arts

A combination of fireworks is a combination of a plurality of monocular cylinder firework. A monocular cylinder is called a shot. Conventional combination of fireworks is assembled from a plurality of paper bobbins, it has many drawbacks. The processes of the conventional fireworks are complicated, and the productivity is low, and the regulatory or the standard of the products are hard to control.

In recent years, our company had developed a product of one-time molding combined fireworks by molding the slurry as a whole piece. The shape and structure of the molded body is similar to the conventional combined fireworks, the overall appearance of the molded body shape is generally rounded prism or cylinder, etc. A plurality of parallel tubular cavities is evenly distributed on the body. The structure and the function of tubular cavity body are similar to the monocular cylinder of conventional fireworks. The upper ends of the tubular cavity bodies are open, while the lower ends of the tubular cavity bodies are closed. Firework powder and effect parts are provided inside the tubular cavity bodies. It is worth to mention that different from the conventional combined fireworks which uses side flash connected fuse structure, the new combined firework uses bottom flash connected fuse structure. The closed end of the tubular cavity bodies is provided a flash hole which penetrates the bottom of the whole body. A wiring groove connecting all fire transmission holes is provide on the bottom surface to ensure the positioning of fuse. And the fuse is embedded in the wiring groove connecting each flash hole sequentially. By igniting the fuse, the firework powder is ignited and the fireworks are launched. Refer to Chinese patent CN 101377395B, authorized date Apr. 11, 2012, entitled "Fireworks Molded Outer Tube, Shell Spherical Shell and its Production", the production process is disclosed.

However, we found that in practice, the one-time molded combined fireworks still have some drawbacks. A phenomenon of blaze can easily emerge, that is the firework powder and effect parts in each tubular cavity bodies are not ignited and launched in accordance with predetermined ignition sequence, but the situation occurs two or more tubular cavities simultaneously launched, which leads to the firework effect are completely ruined.

SUMMARY OF THE PRESENT INVENTION

One object of the present invention is to provide a molded combined firework, which can effectively prevent the occurrence of blaze, in order to achieve the designed effect of fireworks. To solve the mentioned problems, the present invention provided a molded combined firework, comprising a plurality of parallel tubular cavities evenly distributed on the body. The upper ends of the tubular cavity bodies are open while the lower ends are closed. Firework powder and effect parts are provided inside the tubular cavity bodies. A flash hole is provided on the sealed end, penetrating the bottom surface of the body. The opening of the flash hole is provided inside a wiring groove. Within the wiring groove and the bottom opening of flash hole, a truncated groove is provided between thereof. The wiring groove is sealed with glue.

Base on research, blaze phenomenon occurs for the following reasons. After the fuse is embedded within wiring groove, a gap exists between the fuse and both the side walls and bottom surface of the wiring groove. The continuous existing gap within a portion of wiring groove will lead to the occurrence of fire jump between the flash holes within the wiring groove. Due to the spread speed of high pressure combustion gases along the wiring groove is faster than that of the fuse, the gas pass through the gap and flee into the flash holes, so that the firework powder and the effect parts inside the tubular cavity bodies is disordered ignited by the gas.

Using glue to seal the wiring groove can reduce the occurrence of fire jump. The glue can be existing commercial products in current firework material market such as moisture-proof glue, etc. In order to improve the fire truncation performance of the glue, and has good flow distribution and adhesive properties. Preferably, the glue component is: in parts by weight ratio, 1 to 2 order of moisture-proof glue, 2 to 4 orders of calcium carbonate. Mixing evenly using general method.

However, due to the perfect match between the glue distribution and the gap is difficult to achieve, the gap can still be exist, especially between the fuse and bottom surface of the wiring groove. Therefore, a blocking groove is provided inside the wiring groove. The depth of the blocking groove is relatively deeper than that of wiring groove. The blocking groove is disposed between the bottom openings of the flash holes, so that the glue can easily fill the wiring groove and form a closed ring shape along the cross-sectional direction of the fuse, preventing the blaze phenomenon from occurring. In addition, paths through which burning high-pressure powder gas flows out from an ignition hole and causes accidents are blocked, the powder gas in all the tubular cavity bodies is restrained to flow out only from the upper ends of the tubular cavity bodies; therefore, the safety of products is ensured, the amount of powder is standardized, and the quality of setting off fireworks is improved.

As can be seen from the above analysis, the blocking groove may be integrally disposed (e.g. be disposed like a U-shape along the inner walls of the cross section of the wiring groove) or partially disposed (e.g. be disposed along the inner walls of the cross section of a portion of wiring groove). The length, width and depth of the blocking groove can be adjusted according to the actual situation. Considering the truncation performance and the manufacturing factors, preferably, the blocking groove is provided on the bottom surface of the wiring groove. Preferably, the width of the blocking groove is larger than the width of the wiring groove. Preferably, the blocking groove is a rectangular blind hole.

Preferably, a flash hole is provided on the closed end of the tubular cavity bodies which penetrates the bottom surface of the body. The wiring groove is a continuous integral groove; each bottom opening of the flash hole is disposed inside the integral groove. When in use, only one fuse is embedded in the wiring groove, and the requirement of flash is fulfilled. There is no need to provide an extra fuse for each of the flash hole. The fuse combusts in the wiring groove and the combustion gas spark goes into the tubular cavity bodies through the flash hole. Then, the firework powder and effect part in the tubular cavity bodies is ignited.

Since the bottom of some products are thick, making the length of the flash along the axial direction is long, the fuse combust spark cannot reach the firework powder through the flash hole, leading to the firework powder in the tubular cavity bodies cannot be ignited which seriously affect the discharge effect. In order to avoid mentioned case, preferably, the flash hole is a tapered hole. The tapered top is on the bottom of the body, and the tapered bottom is along the direction of the bottom of the tubular cavity bodies. In this case, the firework powder fills the tapered tunnel and gets closer to the fuse. Then, the fuse combustion sparks can reach the firework powder and fully ignite the powder, to ensure there is no noncombustible case.

Preferably, the corners of the continuous integral groove are arc shaped corner. This can reduce the extent the fuse folded at the corners, and prevent the fuse from wearing or broken, avoiding the fuse breakage caused product quality problems.

Preferably, two flash holes are provided on the closed end of the tubular cavity bodies which penetrates the bottom of the body. One is flash enter hole and the other is flash exit hole. The wiring groove comprises a plurality of intermittent decentralized grooves. Besides a flash enter hole connecting the fuse and a flash exit hole connecting a back-up fuse, a flash enter hole of a tubular cavity body and another flash enter hole of adjacent tubular cavity body is located within the same distributed groove. The blocking groove is provided between the two bottom openings. When in use, a plurality of fuse is provided according to the number of the distributed groove, the ends of each fuse is inserted into the flash enter hole and the flash exit hole on the wiring groove.

Preferably, the bottom surface of the body is surrounded by a protruded border. A plurality of ventilation relief slots are provided on the border. The protruded border can make the product underside off the ground, to prevent the product from getting moisture and damage. And the ventilation relief slots on one hand can make underside ventilation accelerate drying; and on the other hand if the bottom surface of firework has combustion gas leaking, the pressure can be timely released to avoid dumping and causing more accidents.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

First Preferred Embodiment

Figure 1:
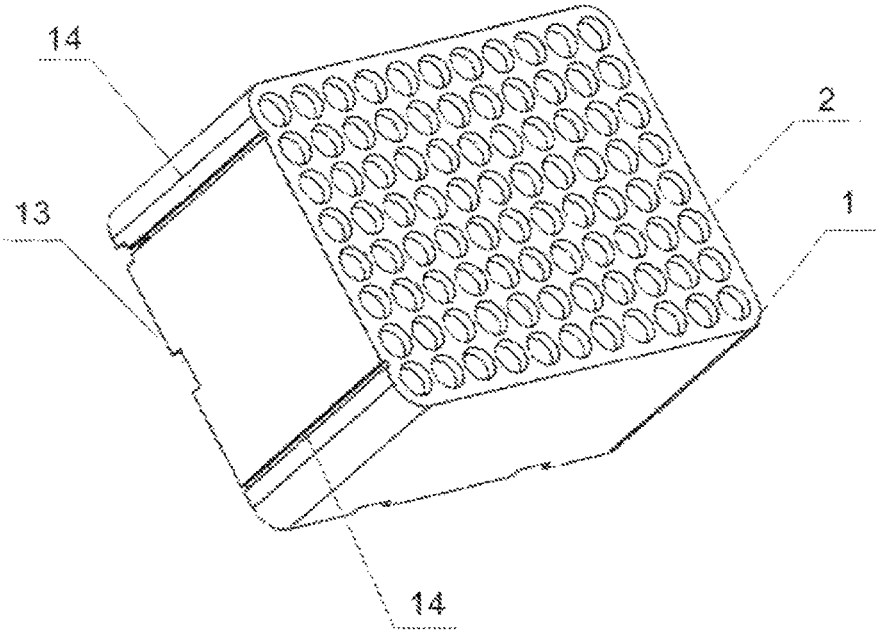
FIG. 1 is a schematic illustration of the overall structure of first preferred embodiment.
Figure 2:
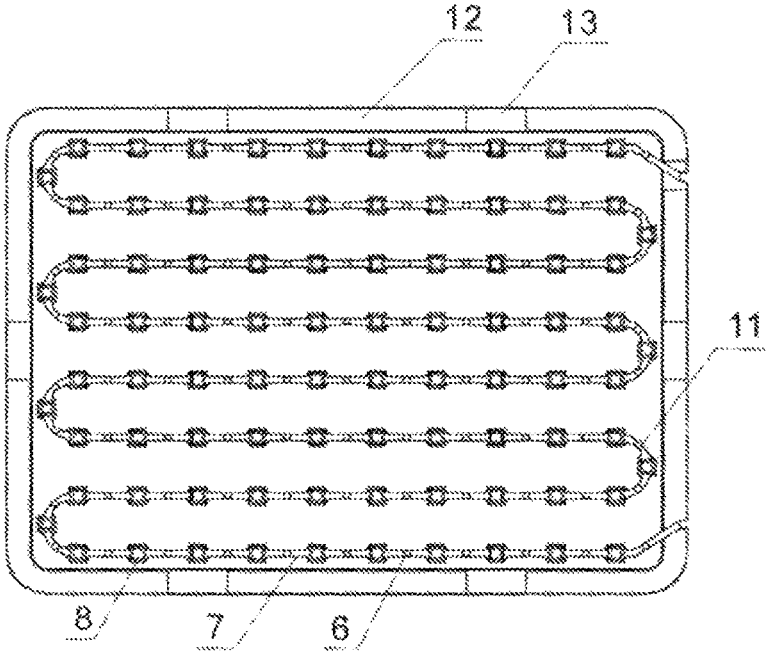
FIG. 2 is a bottom structural schematic view of the first preferred embodiment.
Figure 3:
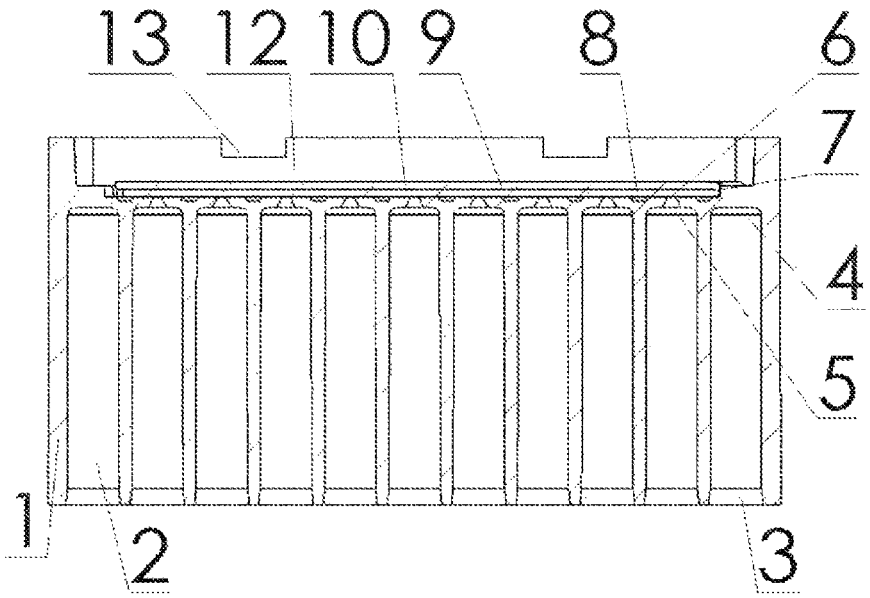
FIG. 3 is a cross-sectional structural schematic view of the first preferred embodiment.

Referring to FIGS. 1 to 3, which illustrate a specific configuration of the present invention. The first preferred embodiment is an eighty-eight shots one-time molded combined firework. The molded combined firework comprises a main body 1 and eighty-eight parallel evenly distributed tubular cavity bodies 2. An upper end 3 of the tubular cavity body 2 is open, and a lower end 3 of the tubular cavity body 2 is sealed, while firework powder and effect part are provided inside the tubular cavity bodies 2. A flash hole 5 is provided on the sealed end of the tubular cavity bodies 2 which penetrates the bottom of the main body 1. A bottom opening 6 is provided on each of the flash hole 5 and disposed within a wiring groove 7. A blocking groove 8 is disposed between the inner wall of the wiring groove 7 and the bottom opening 6 of the flash hole 5. After installing a fuse 10 in the wiring groove 7, glue 9 is used to seal the wiring groove 7. Component of the glue is: in parts by weight ratio, one-point-two orders of moisture-proof glue and three orders of calcium carbonate. Mixing evenly using general method. The blocking groove 8 is provided on the bottom surface of the wiring groove 7. The blocking groove 8 is a rectangular blind hole with a width larger than that of the wiring groove 7. The bottom surface of the main body 1 is surrounded by a protruded border 12. Six ventilation relief slots 13 are provided on the border 12.

In this embodiment, each of the tubular cavity bodies 2 is provided with a flash hole 5, referring to FIG. 2. The wiring groove 7 is a continuous integral groove, and the corners 11 are arc-shaped corners. Each bottom opening 6 of eighty-eight flash hole 5 is located within the wiring groove 7. The blocking groove 8 is disposed between each of the bottom opening 6. When in use, only one fuse 10 is embedded in the wiring groove 7. Both ends of the fuse 10 pass through a side wiring groove 14 on the main body 1 and reaches the upper surface of the main body 1, which can be used as an ignition fuse and a back-up ignition fuse. The flash hole 5 is a tapered hole, the tapered top is on the bottom of the main body 1, and the tapered bottom is along the direction of the inner bottom of the tubular cavity bodies 2.

As can be seen, the blocking groove 8 is provided between two bottom openings 6 of the flash hole 5, thus glue 9 can easily fills the wiring groove 7, forming a closed ring shape along the direction of the cross section of the fuse 10 to truncate combustion gas travelling along the gap.

Second Preferred Embodiment

Figure 4:
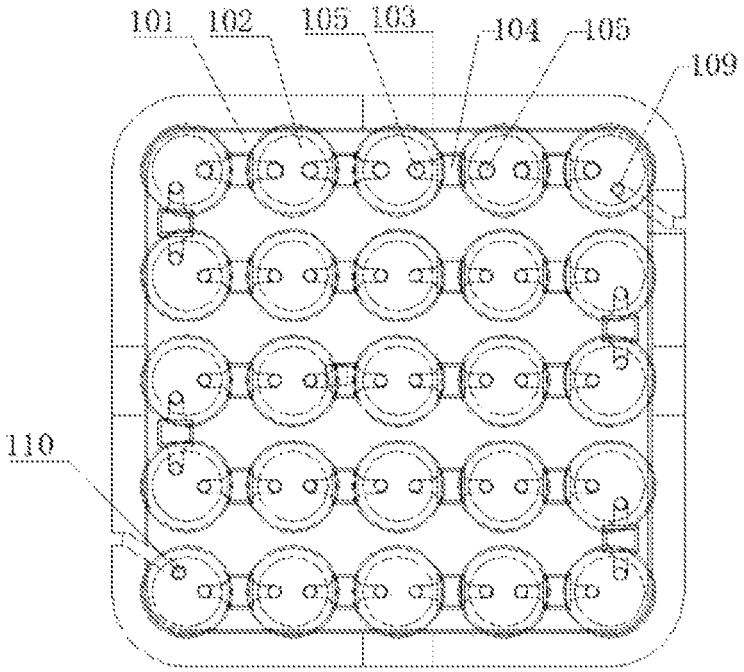
FIG. 4 is a bottom structural schematic view of the second preferred embodiment.
Figure 5:
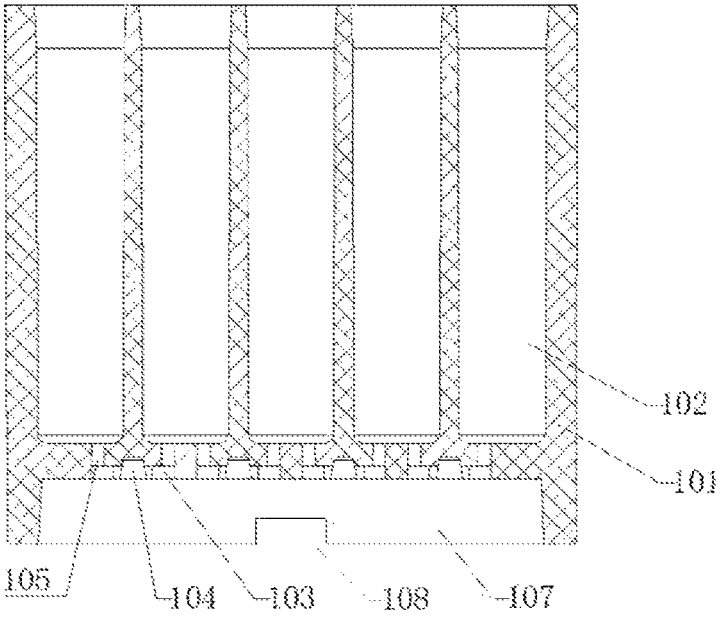
FIG. 5 is a cross-sectional structural schematic view of the second preferred embodiment. (fuse and glue are not applied state)
Figure 6:
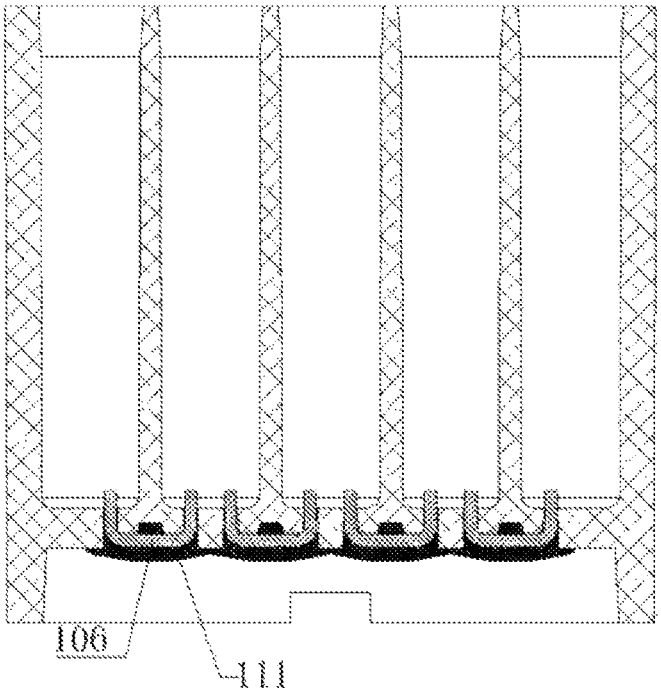
FIG. 6 is a cross-sectional structural schematic view of the second preferred embodiment. (fuse and glue are applied state)

Referring to FIGS. 4 to 6, which illustrate another specific structure of the present invention. The second preferred embodiment is a twenty-five shots one-time molded combined firework. Similarly, the molded combined firework comprises a main body 101 and twenty-five parallel evenly distributed tubular cavities 102. The upper ends of the tubular cavity bodies 102 are open, and the lower ends of the tubular cavity bodies 102 are closed, while firework powder and effect part are provided inside the tubular cavity bodies 102. A flash hole 105 is provided on the closed end of the tubular cavity body 102 which penetrates the bottom of the main body 101. A bottom opening is provided on each of the flash hole 105 and disposed within a wiring groove 103. A blocking groove 104 is disposed between the inner wall of the wiring groove 103 and the bottom opening of the flash hole 105. After installing a fuse 106 in the wiring groove 104, glue is used to seal the wiring groove 104. The blocking groove 104 is provided on the bottom surface of the wiring groove 103. The blocking groove 104 is a rectangular blind hole. The bottom surface of the main body 101 is surrounded by a protruded border 107. Four ventilation relief slots 108 are provided on the border 107.

The difference between the first preferred embodiment and the second preferred embodiment is that, in this embodiment, each of the tubular cavity bodies is provided with two flash holes 105, one of them is a flash enter hole, and the other is a flash exit hole. The wiring groove 104 comprises twenty-four mutual intermittent dispersed style grooves. As can be seen from FIG. 4, there are fifty flash hole 105, besides an flash enter hole 109 connecting fuse and a flash exit hole 110 connecting back-up fuse, the remaining forty-eight holes combines into twenty-four groups in a way of one-inlet-one-outlet, in other words, a flash enter hole of a tubular cavity body 102 pairs with a flash exit hole of the adjacent tubular cavity body 102. Two bottom openings of each pair of the flash holes 105 are disposed within the same wiring groove 103. The blocking groove 104 is provided between the two bottom openings. When in use, a plurality of fuses 106 are provided according to the number of distributed groove, two ends of each fuse 106 is inserted into the flash enter hole and the flash exit hole within the groove separately. After the ignition, the order of fire transmission is like the following: fuse ignition, the flash enter hole 109, the firework powder inside the tubular cavity body where the flash enter hole 109 located, the flash exit hole of the tubular cavity body where the flash enter hole 109 located, the flash enter hole of the adjacent tubular cavity body, the firework powder inside the adjacent tubular cavity body, the flash exit hole of the adjacent tubular cavity body. In such order, the fuse finally goes to the flash exit 110 and the back-up ignition fuse. When using the back-up fuse, the order is reversed.

As can be seen, the blocking groove 104 is provided between two bottom openings of the flash hole 105, thus glue can easily fills the wiring groove 103, forming a closed ring shape along the direction of the cross section of the fuse 106 to truncate combustion gas travelling along the gap.

Third Preferred Embodiment

Figure 7:
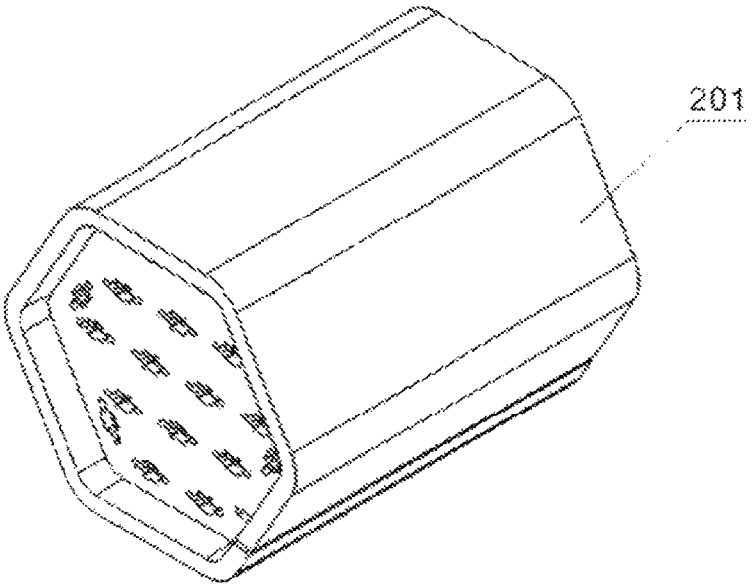
FIG. 7 is a schematic illustration of the overall structure of third preferred embodiment.
Figure 8:
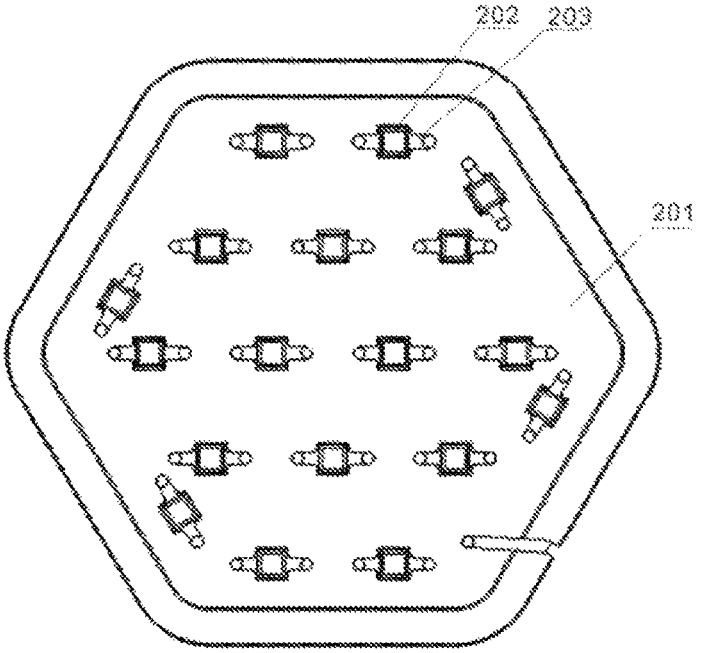
FIG. 8 is a bottom structural schematic view of the third preferred embodiment.

Referring to FIGS. 7 and 8, the difference from the second preferred embodiment is, the third preferred embodiment is a nineteen shots one-time molded combined firework. The main body 201 is a regular hexagon. A blocking groove 202 is provided to make glue easily filling a wiring groove 203, forming a closed ring shape along the direction of the cross section of the fuse to truncate combustion gas travelling along the gap.

Forth Preferred Embodiment

Figure 9:
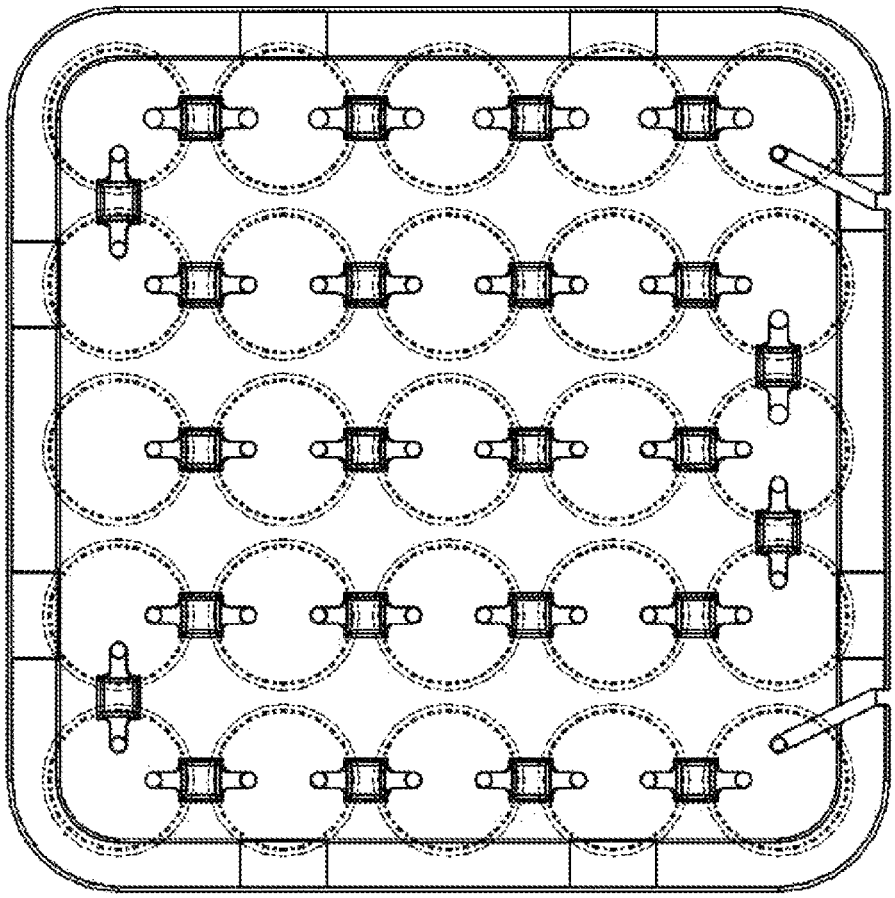
FIG. 9 is a bottom structural schematic view of the forth preferred embodiment.

Referring to FIG. 9, which illustrates a twenty-five shots one-time molded combined firework. The difference from the second preferred embodiment is, in this embodiment, one tubular cavity body provided three flash holes while the other tubular cavity body only provided with one flash hole. This different fire transmission sequence can achieve the requirement of the discharge process design, which is a special volley effect. Similarly, a blocking groove is provided to make glue easily filling a wiring groove, forming a closed ring shape along the direction of the cross section of the fuse to truncate combustion gas travelling along the gap.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications (e.g. the figure of main body, the design of fire transmission or the distribution of wiring groove, etc.) encompassed within the spirit and scope of the following claims.

What is claimed is:

1. A compression molded combined firework, comprising:

a plurality of tubular cavity bodies evenly distributed in parallel on a body, wherein upper ends of said tubular cavity bodies are open and lower ends of said tubular cavity bodies are closed, wherein chemicals for launching fireworks and effect parts are disposed in said tubular cavity bodies, wherein two or more flash holes are provided penetrating through a bottom surface of said body, wherein bottom openings of said flash holes are located in a wiring groove, wherein a blocking groove being provided in said wiring groove and between said bottom openings of said flash holes, wherein said wiring groove is sealed with glue.

2. A compression molded combined firework, as recited in claim 1, wherein said blocking groove is disposed on an inner bottom surface of said wiring groove.

3. A compression molded combined firework, as recited in claim 2, wherein a width of said blocking groove is larger than a width of said wiring groove.

4. A compression molded combined firework, as recited in claim 2, wherein said blocking groove is a rectangular blind hole.

5. A compression molded combined firework, as recited in claim 1, wherein said bottom surface of said body is surrounded by a protruded border, wherein a plurality of ventilation relief slots are provided on said border.

6. A compression molded combined firework, as recited in claim 1, wherein said glue comprises in parts by weight ratio, one to two order of moisture-proof glue and two to four orders of calcium carbonate.

7. A compression molded combined firework, as recited in claim 1, wherein each of said flash holes penetrating through said bottom surface of said body is provided on each of said lower ends of said tubular cavity bodies, wherein said wiring groove is a continuous integral groove, wherein said bottom openings of said flash holes are located in said integral groove, wherein said blocking groove is disposed between each of said bottom openings.

8. A compression molded combined firework, as recited in claim 7, wherein said flash holes are tapered holes, each of said flash holes having a tapered top along a direction of the bottom of said body and a tapered bottom along a direction of bottoms of said tubular cavity bodies.

9. A compression molded combined firework, as recited in claim 7, wherein corners of said continuous integral groove are arc-shaped corners.

10. A compression molded combined firework, as recited in claim 1, wherein each of said tubular cavity bodies has two of said flash holes penetrating through said bottom surface of said body, wherein, in each of said tubular cavity bodies, one of said flash holes is a flash enter hole and another one of said flash holes is a flash exit hole, wherein said wiring groove comprises a plurality of intermittent distributed grooves, wherein beside one of said flash enter holes connecting a fuse and one of said flash exit holes connecting a spare fuse, the rest of said flash enter holes are paired with the rest of said flash exit holes respectively, wherein two said bottom openings of each pair of flash holes are disposed within same said wiring groove, wherein said blocking groove is disposed between two of said bottom openings.

11. A compression molded combined firework, as recited in claim 3, wherein said blocking groove is a rectangular blind hole.

12. A compression molded combined firework, as recited in claim 2, wherein one of said flash holes penetrating through said bottom surface of said body is provided on each of said lower ends of said tubular cavity bodies, wherein said wiring groove is a continuous integral groove, wherein said bottom openings of said flash holes are located in said integral groove, wherein said blocking groove is disposed between each of said bottom openings.

13. A compression molded combined firework, as recited in claim 3, wherein one of said flash holes penetrating through said bottom surface of said body is provided on each of said lower ends of said tubular cavity bodies, wherein said wiring groove is a continuous integral groove, wherein said bottom openings of said flash holes are located in said integral groove, wherein said blocking groove is disposed between each of said bottom openings.

14. A compression molded combined firework, as recited in claim 5, wherein one of said flash holes penetrating through said bottom surface of said body is provided on each of said lower ends of said tubular cavity bodies, wherein said wiring groove is a continuous integral groove, wherein said bottom openings of said flash holes are located in said integral groove, wherein said blocking groove is disposed between each of said bottom openings.

15. A compression molded combined firework, as recited in claim 6, wherein one of said flash holes penetrating through said bottom surface of said body is provided on each of said lower ends of said tubular cavity bodies, wherein said wiring groove is a continuous integral groove, wherein said bottom openings of said flash holes are located in said integral groove, wherein said blocking groove is disposed between each of said bottom openings.

16. A compression molded combined firework, as recited in claim 12, wherein said flash holes are tapered holes, each of said flash holes having a tapered top along a direction of the bottom of said body and a tapered bottom along a direction of bottoms of said tubular cavity bodies.

17. A compression molded combined firework, as recited in claim 13, wherein said flash holes are tapered holes, each of said flash holes having a tapered top along a direction of the bottom of said body and a tapered bottom along a direction of bottoms of said tubular cavity bodies.

18. A compression molded combined firework, as recited in claim 14, wherein said flash holes are tapered holes, each of said flash holes having a tapered top along a direction of the bottom of said body and a tapered bottom along a direction of bottoms of said tubular cavity bodies.

19. A compression molded combined firework, as recited in claim 15, wherein said flash holes are tapered holes, each of said flash holes having a tapered top along a direction of the bottom of said body and a tapered bottom along a direction of bottoms of said tubular cavity bodies.

20. A compression molded combined firework, as recited in claim 12, wherein corners of said continuous integral groove are arc-shaped corners.

21. A compression molded combined firework, as recited in claim 13, wherein corners of said continuous integral groove are arc-shaped corners.

22. A compression molded combined firework, as recited in claim 14, wherein corners of said continuous integral groove are arc-shaped corners.

23. A compression molded combined firework, as recited in claim 15, wherein corners of said continuous integral groove are arc-shaped corners.

24. A compression molded combined firework, as recited in claim 2, wherein each of said tubular cavity bodies has two of said flash holes penetrating through said bottom surface of said body, wherein, in each of said tubular cavity bodies, one of said flash holes is a flash enter hole and another one of said flash holes is a flash exit hole, wherein said wiring groove comprises a plurality of intermittent distributed grooves, wherein beside one of said flash enter holes connecting a fuse and one of said flash exit holes connecting a spare fuse, the rest of said flash enter holes are paired with the rest of said flash exit holes respectively, wherein two said bottom openings of each pair of flash holes are disposed within same said wiring groove, wherein said blocking groove is disposed between two of said bottom openings.

25. A compression molded combined firework, as recited in claim 3, wherein each of said tubular cavity bodies has two of said flash holes penetrating through said bottom surface of said body, wherein, in each of said tubular cavity bodies, one of said flash holes is a flash enter hole and another one of said flash holes is a flash exit hole, wherein said wiring groove comprises a plurality of intermittent distributed grooves, wherein beside one of said flash enter holes connecting a fuse and one of said flash exit holes connecting a spare fuse, the rest of said flash enter holes are paired with the rest of said flash exit holes respectively, wherein two said bottom openings of each pair of said flash holes are disposed within same said wiring groove, wherein said blocking groove is disposed between two of said bottom openings.

26. A compression molded combined firework, as recited in claim 5, wherein each of said tubular cavity bodies has two of said flash holes penetrating through said bottom surface of said body, wherein, in each of said tubular cavity bodies, one of said flash holes is a flash enter hole and another one of said flash holes is a flash exit hole, wherein said wiring groove comprises a plurality of intermittent distributed grooves, wherein beside one of said flash enter holes connecting a fuse and one of said flash exit holes connecting a spare fuse, the rest of said flash enter holes are paired with the rest of said flash exit holes respectively, wherein two said bottom openings of each pair of said flash holes are disposed within same said wiring groove, wherein said blocking groove is disposed between two of said bottom openings.

27. A compression molded combined firework, as recited in claim 6, wherein each of said tubular cavity bodies has two of said flash holes penetrating through said bottom surface of said body, wherein, in each of said tubular cavity bodies, one of said flash holes is a flash enter hole and another one of said flash holes is a flash exit hole, wherein said wiring groove comprises a plurality of intermittent distributed grooves, wherein beside one of said flash enter holes connecting a fuse and one of said flash exit holes connecting a spare fuse, the rest of said flash enter holes are paired with the rest of said flash exit holes respectively, wherein two said bottom openings of each pair of said flash holes are disposed within same said wiring groove, wherein said blocking groove is disposed between two of said bottom openings.

* * * * *